US007084862B2

(12) United States Patent
Matsumoto

(10) Patent No.: US 7,084,862 B2
(45) Date of Patent: Aug. 1, 2006

(54) ACTIVE MATRIX SEMICONDUCTOR DEVICE

(75) Inventor: Shoichiro Matsumoto, Oogaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 210 days.

(21) Appl. No.: 10/287,521

(22) Filed: Nov. 5, 2002

(65) Prior Publication Data

US 2003/0089916 A1 May 15, 2003

(30) Foreign Application Priority Data

Nov. 14, 2001 (JP) ..... 2001-348747

(51) Int. Cl.
*G09G 5/00* (2006.01)
*G09G 3/36* (2006.01)
*G09G 3/30* (2006.01)

(52) U.S. Cl. ..... 345/204; 345/87; 345/99; 345/100; 345/104

(58) Field of Classification Search ..... 345/30, 345/42, 50, 52, 55, 61, 80, 87, 100, 104, 345/204, 205, 206, 214
See application file for complete search history.

(56) References Cited

U.S. PATENT DOCUMENTS 4,631,592 A * 12/1986 Nishizawa ..... 348/307
5,194,862 A * 3/1993 Edwards ..... 341/20
5,850,216 A * 12/1998 Kwon ..... 345/204
6,271,818 B1 * 8/2001 Yamazaki et al. ..... 345/92
6,583,777 B1 * 6/2003 Hebiguchi et al. ..... 345/92
2001/0005193 A1 * 6/2001 Yokoyama ..... 345/92
2001/0015712 A1 * 8/2001 Hashimoto ..... 345/92

FOREIGN PATENT DOCUMENTS

| | | |
|---|---|---|
| JP | 63-101832 | 5/1988 |
| JP | 5-210364 | 8/1993 |
| JP | 9-127919 | 5/1997 |
| JP | 2001-174843 A | 8/2001 |
| JP | 2002-175026 | 6/2002 |
| JP | 2002-175035 | 6/2002 |
| WO | WO 01-29814 A1 | 4/2001 |

* cited by examiner

*Primary Examiner*—Amare Mengistu
*Assistant Examiner*—Alexander S. Beck
(74) *Attorney, Agent, or Firm*—McDermott Will & Emery LLP

(57) ABSTRACT

Provided is a semiconductor device, including a pixel part or a sensor part, capable of reducing the size of a connector part connecting the semiconductor device with an external IC in correspondence to miniaturization of the semiconductor device also when the semiconductor device is miniaturized. In this semiconductor device, a pixel part or a sensor part arranged in the form of a matrix, a scanning system driving circuit driving a gate line, a data system driving circuit driving a drain line and a scanning system control signal generation circuit generating a control signal for the scanning system driving circuit are formed on an identical substrate. Thus, a scanning system control signal is generated in the substrate, whereby the number of external input signals is reduced. Therefore, the number of signal lines wired to the connector part connected to the semiconductor device is reduced, whereby the size of the connector part can be reduced.

17 Claims, 14 Drawing Sheets

ACTIVE MATRIX SEMICONDUCTOR DEVICE

BACKGROUND OF THE INVENTION

1. Field of the Invention

The present invention relates to a semiconductor device, and more particularly, it relates to an active matrix semiconductor device including a pixel part and a sensor part.

2. Description of the Background Art

A portable device has recently been increasingly loaded with a display or a sensor. FIG. 10 is a block diagram showing a panel part and an external IC part of a conventional display. Referring to FIG. 10, a pixel part 150, a data system driving circuit 151, a scanning system driving circuit 152 and level conversion circuits 101, 102, 103, 104 an 105 are formed on an identical panel 200 in the conventional display. Drain lines and gate lines are arranged on the pixel part 150 in the form of a matrix. The data system driving circuit 151 is provided for driving the drain lines. The scanning system driving circuit 152 is provided for driving the gate lines.

The level conversion circuits 101, 102, 103, 104 and 105 are employed for level-converting the amplitudes (3 to 5 V) of external signals HST, HCK, VCK, VST and RST to 8 to 15 V respectively. The signals RST, VST, VCK, HCK and HST received from an external IC 120 are principal signals included in a group of driving signals externally input in the panel 200, and FIG. 10 does not show all signals necessary for driving the pixel part 150. These signals are complementary signals, which are regularly present in pairs (e.g., RST and/RST). The external IC 120 stores a clock generator 121 including a crystal oscillator.

FIGS. 11 to 14 are timing charts of respective signals in the conventional display shown in FIG. 10. Operations of the conventional display are now described with reference to FIGS. 10 to 14.

First, clocks HCK1 and HCK2 and clocks VCK1 and VCK2 are regularly externally input in the panel 200 at certain timing. After a reset signal RST is out and goes high, the display starts writing data in the pixel part 150. The outline of this conventional driving sequence is now described.

(1) After the reset signal (RST) is out and goes high, the first gate line gate1 rises in synchronization with the signals VCK.

(2) Then, a pulse signal HST is generated in time with the clocks HCK. Thus, a drain line selection signal h-sw1 is activated. While the drain line selection signal h-sw1 is activated, a video signal is input in a drain line as shown in FIG. 14.

(3) When a final data line selection signal h-swn is activated, a signal hout is generated to indicate termination of data system scanning.

(4) Generation of the signal hout leads to the leading edge of a next gate line gate2 and generation of the signals HST.

(5) When the final gate line gateN rises upon repetition of the aforementioned operations (2) and (3), a signal vout indicating termination of single screen scanning is generated as shown in FIG. 12. FIG. 12 shows the relation between the signals VST, VCK1 and VCK2 and vout.

(6) The aforementioned signal vout leads to the leading edge of the gate line gate1 and generation of the signal HST again.

FIG. 13 shows the relation between a dot clock dotclk and the signals HCK or the signal HST. As shown in FIG. 13, six cycles of the dot clock dotclk correspond to one cycle of the signals HCK.

In the aforementioned driving system for the conventional display, the principal control signals RST, VST, VCK, HCK and HST for driving the data system driving circuit 151 and the scanning system driving circuit 152 are externally input in the panel 200 while these signals RST, VST, VCK, HCK and HST are formed by complementary signal pairs. Therefore, the number of signal lines wired to a connector part connecting the panel 200 with the external IC 120 is disadvantageously increased.

FIGS. 15 and 16 are schematic diagrams for illustrating a problem in a case of miniaturizing the panel 200. As shown in FIG. 15, a connector part 201 for external connection is connected to the panel 200. If the panel 200 including a pixel part is miniaturized in this state, the degree of size reduction of the connector part 201 cannot follow that of a miniaturized panel 200*a* as shown in FIG. 16. Therefore, the size of the connector part 201 problematically exceeds that of the panel 200*a* including a display part.

SUMMARY OF THE INVENTION

An object of the present invention is to provide a semiconductor device, including a pixel part or a sensor part, capable of reducing the size of a connector part in correspondence to miniaturization of the semiconductor device also when the semiconductor device is miniaturized.

Another object of the present invention is to generate at least a scanning system control signal in a substrate in the aforementioned semiconductor device.

In a semiconductor device according to a first aspect of the present invention, a pixel part or a sensor part arranged in the form of a matrix, a scanning system driving circuit driving a gate line, a data system driving circuit driving a drain line and a scanning system control signal generation circuit generating a control signal for the scanning system driving circuit are formed on an identical substrate.

In the semiconductor device according to the first aspect, the scanning system control signal generation circuit generating the control signal for the scanning system driving circuit is formed on the identical substrate in addition to the pixel part or the sensor part, the scanning system driving circuit and the data system driving circuit as hereinabove described so that the scanning system control signal can be generated in the substrate, whereby the number of external input signals can be reduced. Thus, the number of signal lines wired to a connector part connected to the semiconductor device can be reduced, whereby the size of the connector part can be reduced. Consequently, the size of the connector part can be reduced in correspondence to miniaturization of the semiconductor device including the pixel part or the sensor part also when the semiconductor device is miniaturized.

In the semiconductor device according to the aforementioned first aspect, the scanning system control signal generation circuit preferably includes a scanning system synchronizing signal generation circuit generating a scanning system synchronizing signal on the basis of a reset signal and a signal indicating that data system scanning reaches the final stage and a scanning system start signal generation circuit generating a start signal on the basis of at least any of the reset signal, the scanning system synchronizing signal, a signal related to a gate line activation signal rising second and a signal indicating that gate system scanning reaches the final stage. According to this structure, the signal controlling the scanning system driving circuit can be easily generated in the substrate with the scanning system synchronizing signal generation circuit and the scanning system start signal generation circuit.

In the semiconductor device according to the aforementioned first aspect, a data system control signal generation circuit generating a control signal for the data system driving circuit is preferably at least partially formed on the aforementioned identical substrate. According to this structure, not only the scanning system control signal but also at least part of the data system control signal can be generated in the substrate, whereby the number of external input signals can be further reduced. Thus, the number of signal lines wired to the connector part connected to the semiconductor device can be further reduced, whereby the size of the connector part can be further reduced. Consequently, the size of the connector part can be easily reduced in correspondence to miniaturization of the semiconductor device including the pixel part or the sensor part also when the semiconductor device is miniaturized.

In this case, the data system control signal generation circuit preferably includes a basic clock generation circuit for generating a basic clock for the control signal, a data system synchronizing signal generation circuit generating a data system synchronizing signal on the basis of the basic clock and a data system start signal generation circuit generating a start signal on the basis of the basic clock and the data system synchronizing signal, and at least the data system synchronizing signal generation circuit and the data system start signal generation circuit are preferably formed on the identical substrate. According to this structure, the data system control signal can be at least partially easily generated in the substrate.

In this case, the basic clock generation circuit is preferably also formed on the identical substrate in addition to the data system synchronizing signal generation circuit and the data system start signal generation circuit. According to this structure, all data system control signals can be generated in the substrate, whereby the number of external input signals can be further reduced. In this case, the data system synchronizing signal generation circuit may have a function of dividing the output cycle of the basic clock generation circuit to a prescribed magnification. Further, the data system synchronizing signal generation circuit may include a plurality of inverters to have an odd-stage cycle.

In the semiconductor device according to the aforementioned first aspect, a first level conversion circuit for converting the voltage level of an externally input reset signal is preferably further formed on the identical substrate. According to this structure, a reset signal level-converted by the first level conversion circuit can be easily supplied to the scanning system control signal generation circuit or the like formed on the identical substrate. In this case, a second level conversion circuit for converting the voltage level of an externally input data system start signal may be further formed on the identical substrate. According to this structure, a data system start signal level-converted by the second level conversion circuit can be easily supplied to the data system driving circuit. In this case, a third level conversion circuit for converting the voltage level of an externally input data system synchronizing signal may be further formed on the identical substrate. According to this structure, a data system synchronizing signal level-converted by the third level conversion circuit can be easily supplied to the data system driving circuit.

In a display according to a second aspect of the present invention, a pixel part arranged in the form of a matrix, a scanning system driving circuit driving a gate line, a data system driving circuit driving a drain line and a scanning system control signal generation circuit generating a control signal for the scanning system driving circuit are formed on an identical substrate.

In the display according to the second aspect, the scanning system control signal generation circuit generating the control signal for the scanning system driving circuit is formed on the identical substrate in addition to the pixel part, the scanning system driving circuit and the data system driving circuit as hereinabove described so that the scanning system control signal can be generated in the substrate, whereby the number of external input signals can be reduced. Thus, the number of signal lines wired to a connector part connected to the display can be reduced, whereby the size of the connector part can be reduced. Consequently, the size of the connector part can be reduced in correspondence to miniaturization of the display including the pixel part also when the display is miniaturized.

In the display according to the aforementioned second aspect, the scanning system control signal generation circuit preferably includes a scanning system synchronizing signal generation circuit generating a scanning system synchronizing signal on the basis of a reset signal and a signal indicating that data system scanning reaches the final stage and a scanning system start signal generation circuit generating a start signal on the basis of at least any of the reset signal, the scanning system synchronizing signal, a signal related to a gate line activation signal rising second and a signal indicating that gate system scanning reaches the final stage. According to this structure, the signal controlling the scanning system driving circuit can be easily generated in the substrate with the scanning system synchronizing signal generation circuit and the scanning system start signal generation circuit.

In the display according to the aforementioned second aspect, a data system control signal generation circuit generating a control signal for the data system driving circuit is preferably at least partially formed on the aforementioned identical substrate. According to this structure, not only the scanning system control signal but also at least part of the data system control signal can be generated in the substrate, whereby the number of external input signals can be further reduced. Thus, the number of signal lines wired to the connector part connected to the display can be further reduced, whereby the size of the connector part can be further reduced. Consequently, the size of the connector part can be easily reduced in correspondence to miniaturization of the display including the pixel part also when the display is miniaturized.

In this case, the data system control signal generation circuit preferably includes a basic clock generation circuit for generating a basic clock for the control signal, a data system synchronizing signal generation circuit generating a data system synchronizing signal on the basis of the basic clock and a data system start signal generation circuit generating a start signal on the basis of the basic clock and the data system synchronizing signal, and at least the data system synchronizing signal generation circuit and the data system start signal generation circuit are preferably formed on the identical substrate. According to this structure, the data system control signal can be at least partially easily generated in the substrate.

In this case, the basic clock generation circuit is preferably also formed on the identical substrate in addition to the data system synchronizing signal generation circuit and the data system start signal generation circuit. According to this structure, all data system control signals can be generated in the substrate, whereby the number of external input signals can be further reduced.

In a signal detector according to a third aspect of the present invention, a sensor part arranged in the form of a matrix, a scanning system driving circuit driving a gate line, a data system driving circuit driving a drain line and a scanning system control signal generation circuit generating a control signal for the scanning system driving circuit are formed on an identical substrate.

In the signal detector according to the third aspect, the scanning system control signal generation circuit generating the control signal for the scanning system driving circuit is formed on the identical substrate in addition to the sensor part, the scanning system driving circuit and the data system driving circuit as hereinabove described so that the scanning system control signal can be generated in the substrate, whereby the number of external input signals can be reduced. Thus, the number of signal lines wired to a connector part connected to the signal detector can be reduced, whereby the size of the connector part can be reduced. Consequently, the size of the connector part can be reduced in correspondence to miniaturization of the signal detector including the sensor part also when the signal detector is miniaturized.

In the signal detector according to the third aspect, the scanning system control signal generation circuit preferably includes a scanning system synchronizing signal generation circuit generating a scanning system synchronizing signal on the basis of a reset signal and a signal indicating that data system scanning reaches the final stage and a scanning system start signal generation circuit generating a start signal on the basis of at least any of the reset signal, the scanning system synchronizing signal, a signal related to a gate line activation signal rising second and a signal indicating that gate system scanning reaches the final stage. According to this structure, the signal controlling the scanning system driving circuit can be easily generated in the substrate with the scanning system synchronizing signal generation circuit and the scanning system start signal generation circuit.

In the signal detector according to the aforementioned third aspect, a data system control signal generation circuit generating a control signal for the data system driving circuit is preferably at least partially formed on the identical substrate. According to this structure, not only the scanning system control signal but also at least part of the data system control signal can be generated in the substrate, whereby the number of external input signals can be further reduced. Thus, the number of signal lines wired to the connector part connected to the signal detector can be further reduced, whereby the size of the connector part can be further reduced. Consequently, the size of the connector part can be easily reduced in correspondence to miniaturization of the signal detector including the sensor part also when the signal detector is miniaturized.

In this case, the data system control signal generation circuit preferably includes a basic clock generation circuit for generating a basic clock for the control signal, a data system synchronizing signal generation circuit generating a data system synchronizing signal on the basis of the basic clock and a data system start signal generation circuit generating a start signal on the basis of the basic clock and the data system synchronizing signal, and at least the data system synchronizing signal generation circuit and the data system start signal generation circuit are preferably formed on the identical substrate. According to this structure, the data system control signal can be at least partially easily generated in the substrate.

In this case, the basic clock generation circuit is preferably also formed on the identical substrate in addition to the data system synchronizing signal generation circuit and the data system start signal generation circuit. According to this structure, all data system control signals can be generated in the substrate, whereby the number of external input signals can be further reduced.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

First Embodiment

Figure 1:
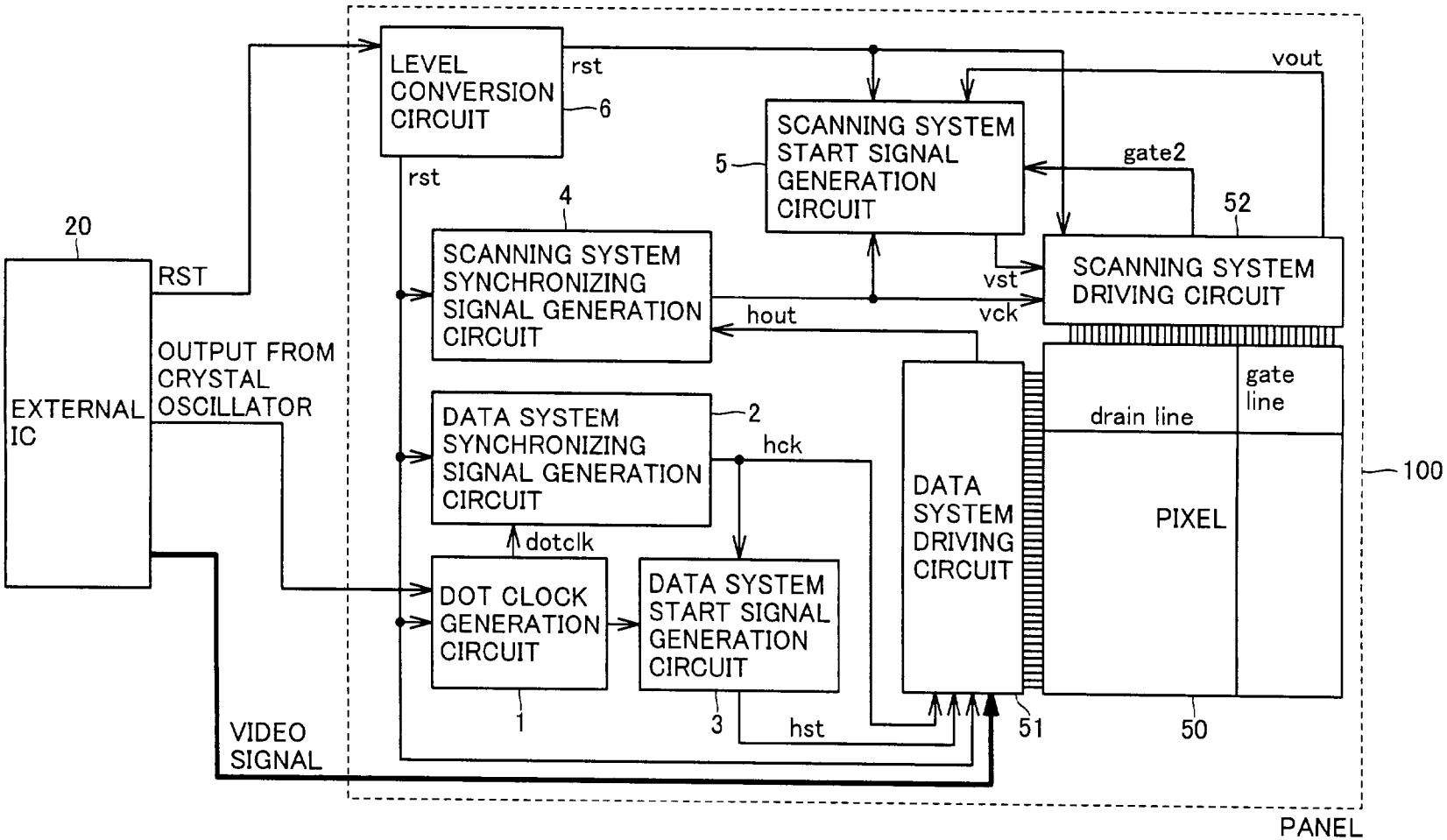
FIG. 1 is a block diagram showing the overall structure of a display according to a first embodiment of the present invention.
Figure 2:
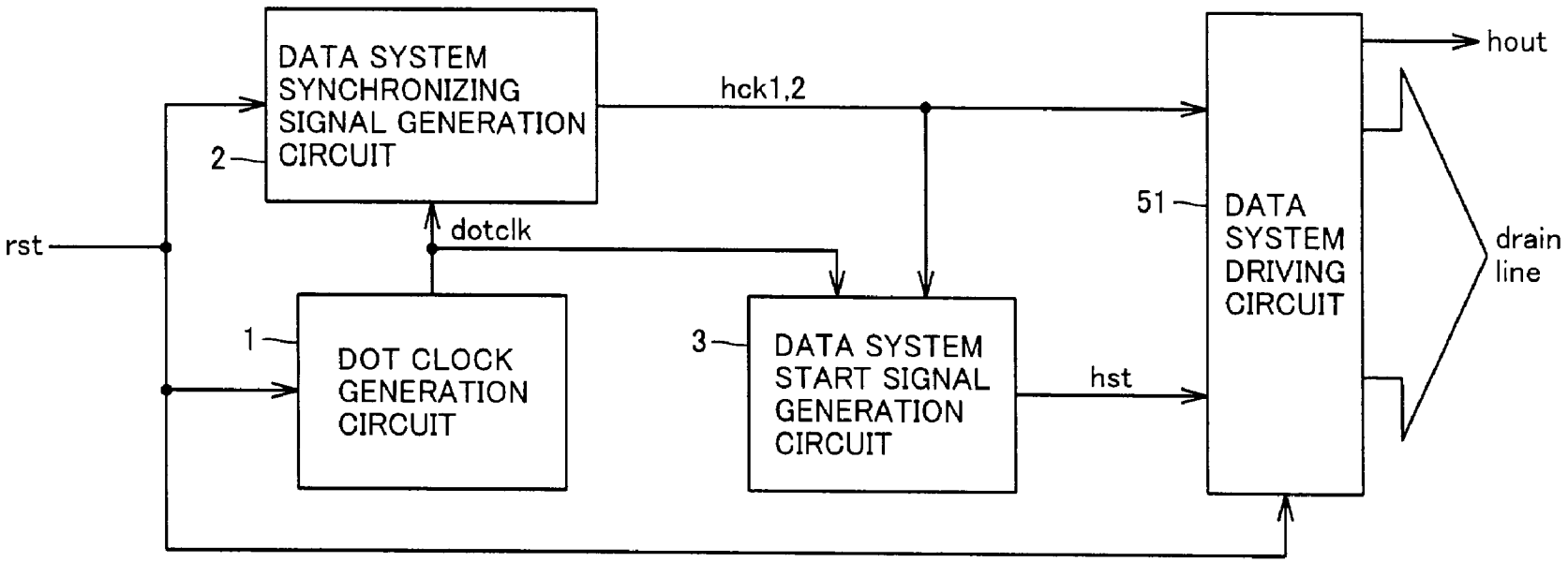
FIG. 2 is a block diagram showing a peripheral portion of a data system driving circuit in the display according to the first embodiment shown in FIG. 1.

The overall structure of a display according to a first embodiment of the present invention is described with reference to FIG. 1. In the display according to the first embodiment, a dot clock generation circuit 1, a data system synchronizing signal generation circuit 2, a data system start signal generation circuit 3, a scanning system synchronizing signal generation circuit 4, a scanning system start signal generation circuit 5, a level conversion circuit 6, a pixel part 50, a data system driving circuit 51 and a scanning system driving circuit 52 are formed on a panel 100. The panel 100 is an example of the "substrate" according to the present invention. Drain lines and gate lines are arranged on the pixel part 50 in the form of a matrix. The data system driving circuit 51 is employed for driving the drain lines, and the scanning system driving circuit 52 is employed for driving the gate lines. The level conversion circuit 6 is employed for level-converting the amplitude (3 to 5 V) of an externally input reset signal RST to 8 to 15 V.

The dot clock generation circuit 1, the data system synchronizing signal generation circuit 2 and the data system start signal generation circuit 3 form a data system control signal generation circuit for generating data system control signals controlling the data system driving circuit 51. The scanning system synchronizing signal generation circuit 4 and the scanning system start signal generation circuit 5 form a scanning system control signal generation circuit for generating scanning system control signals controlling the scanning system driving circuit 52. Thus, the data system control signal generation circuit for generating the control signals controlling the data system driving circuit 51 and the scanning system control signal generation circuit for generating the scanning system control signals controlling the scanning system driving circuit 52 are provided in the panel 100 according to the first embodiment. Therefore, only the reset signal RST, an output of a crystal oscillator and a video signal are input in the panel 100 from an external IC 20.

In other words, the following point is noted in the aforementioned first embodiment: Among the external signals, the video signal and the reset signal RST are indispensable signals. On the other hand, scanning system and data system signals, which are start signals and synchronizing signals, can be generated in the panel 100 if the display requires no high-speed operation (less than 1 MHz).

Figure 3:
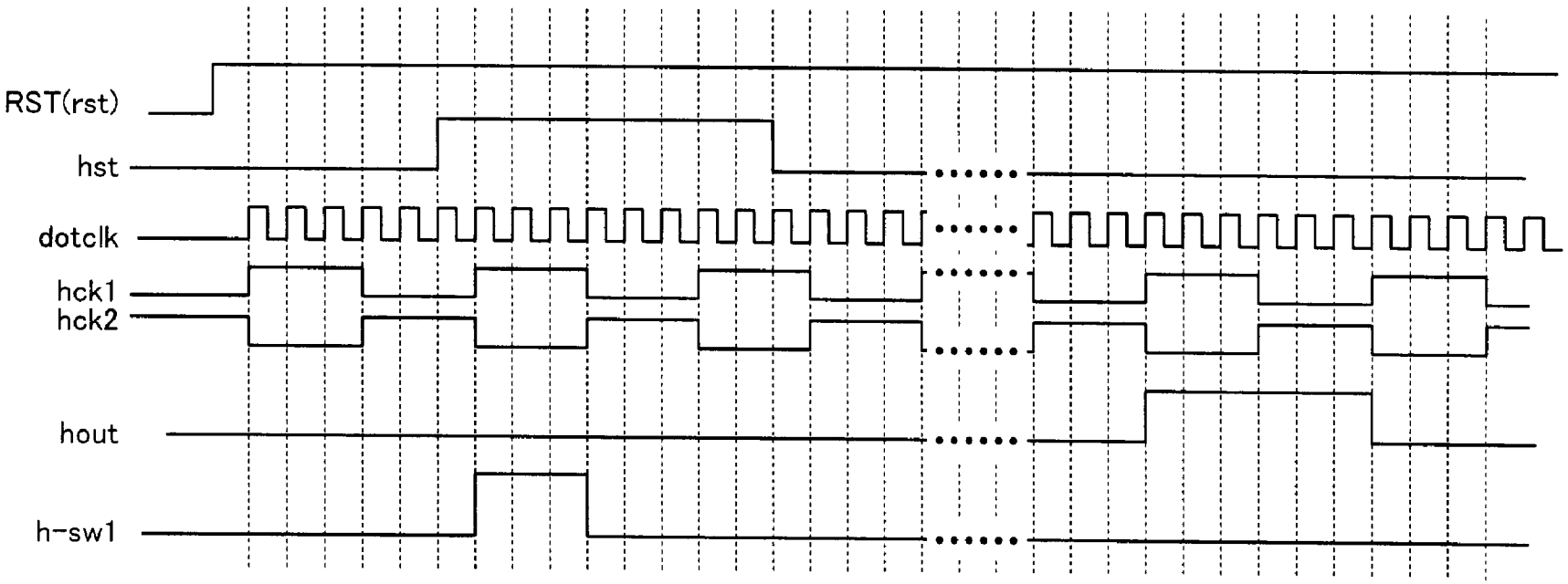
FIG. 3 is a timing chart of data system driving signals in the display according to the first embodiment of the present invention.
Figure 4:
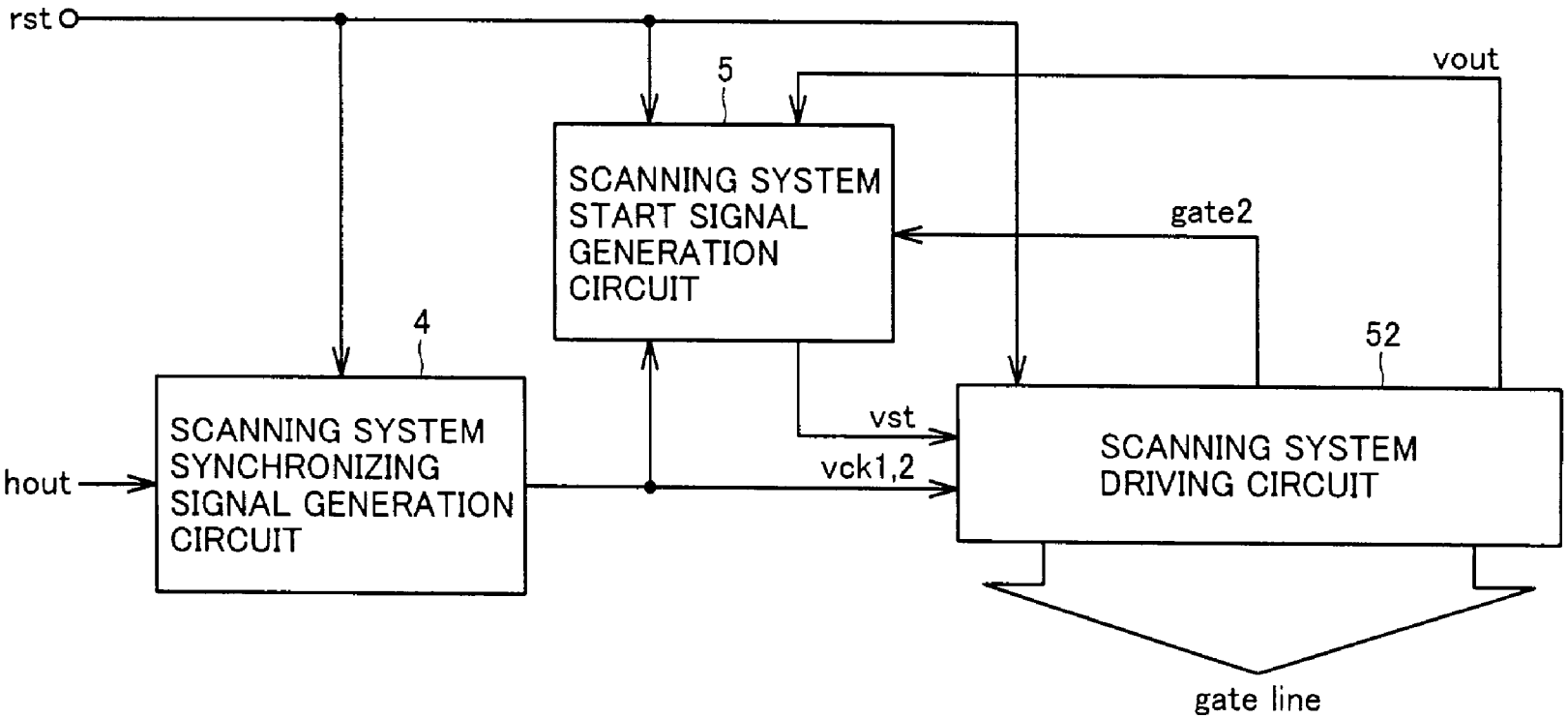
FIG. 4 is a block diagram showing a peripheral portion of a scanning system driving circuit in the display according to the first embodiment shown in FIG. 1.

The dot clock generation circuit 1, the data system synchronizing signal generation circuit 2, the data system start signal generation circuit 3, the scanning system synchronizing signal generation circuit 4 and the scanning system start signal generation circuit 5 are now described in detail. The dot clock generation circuit 1 generates a basic clock (dot clock dotclk) for the control signals on the basis of the output from the crystal oscillator. As shown in FIG. 3, the reset signal RST is released and goes high thereby outputting the dot clock dotclk. The data system synchronizing signal generation circuit 2 has a function of dividing the output cycle of the dot clock generation circuit 1 to some times (three times in this embodiment). The data system start signal generation circuit 3 generates a start signal hst on the basis of the outputs from the dot clock generation circuit 1 and the data system synchronizing signal generation circuit 2.

Figure 6:
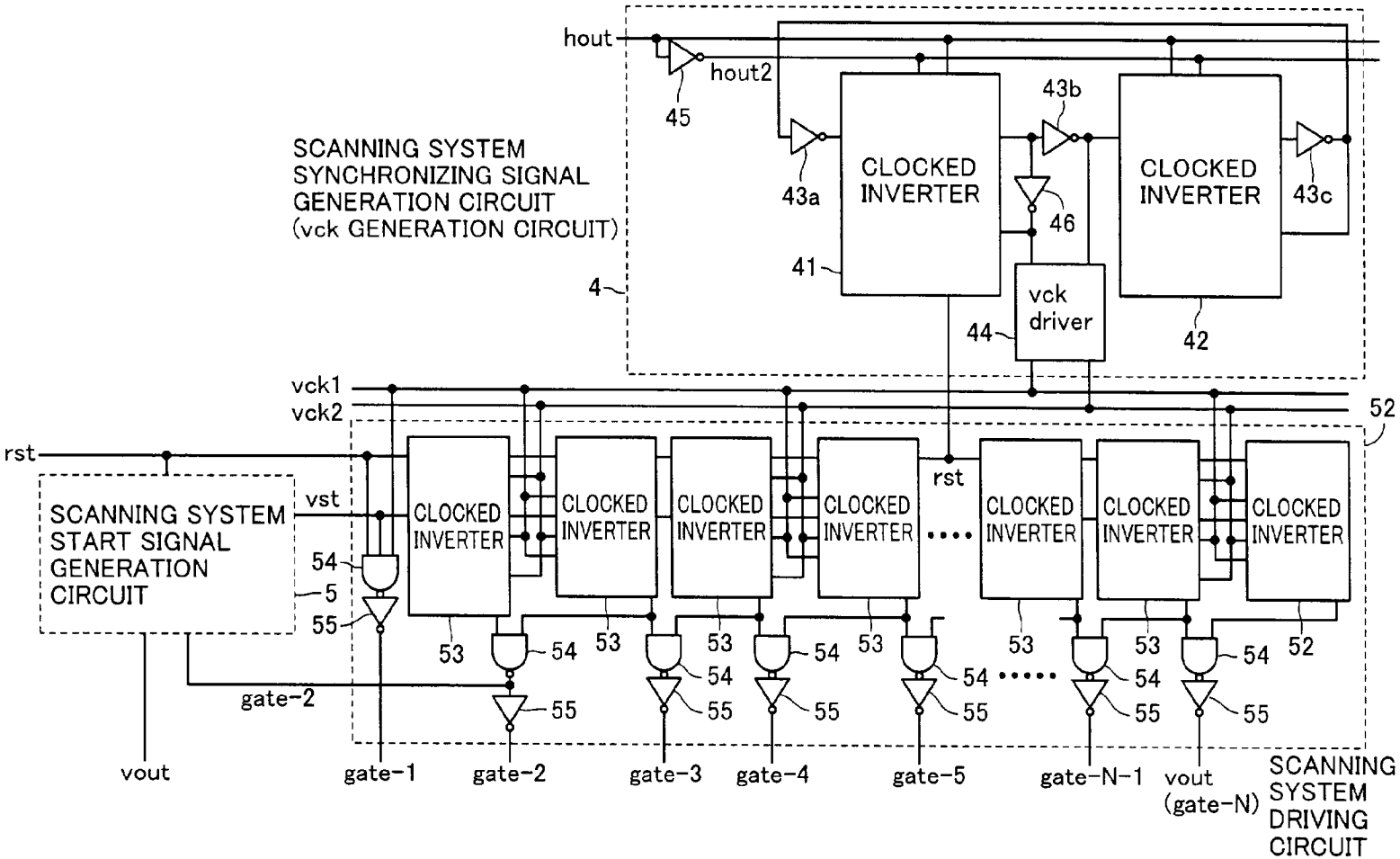
FIG. 6 is a circuit diagram showing the internal structures of the scanning system driving circuit and a scanning system synchronizing signal generation circuit shown in FIG. 4.

The scanning system synchronizing signal generation circuit 4 receives the reset signal RST and a signal hout indicating that data system scanning reaches the final stage, to generate a scanning system synchronizing signal vck. As shown in FIG. 6, the scanning system synchronizing signal generation circuit 4 is formed by two clocked inverters 41 and 42 and three inverters 43*a*, 43*b* and 43*c* to have an odd-stage (five-stage) cycle. The scanning system synchronizing signal generation circuit 4 includes a driver 44 and inverters 45 and 46. The scanning system driving circuit 52 is provided with a clocked inverter 53, a NAND circuit 54 and an inverter 55 in correspondence to each gate line.

The scanning system start signal generation circuit 5 has a function of receiving the reset signal RST, the scanning system synchronizing signal vck, a signal gate2 related to a gate line activation signal rising second and a signal hout indicating that gate system scanning reaches the final stage for generating a scanning system start signal. This scanning system start signal generation circuit 5 also has a function of activating a first gate line gate1 through inactivation of the reset signal RST. The scanning system start signal generation circuit 5 further has a function capable of determining whether or not to scan a second screen with the signal hout indicating that the gate system scanning reaches the final stage. According to this embodiment, the signal hout is generated in response to the leading edge of the final drain line, as shown in FIG. 3.

Figure 5:
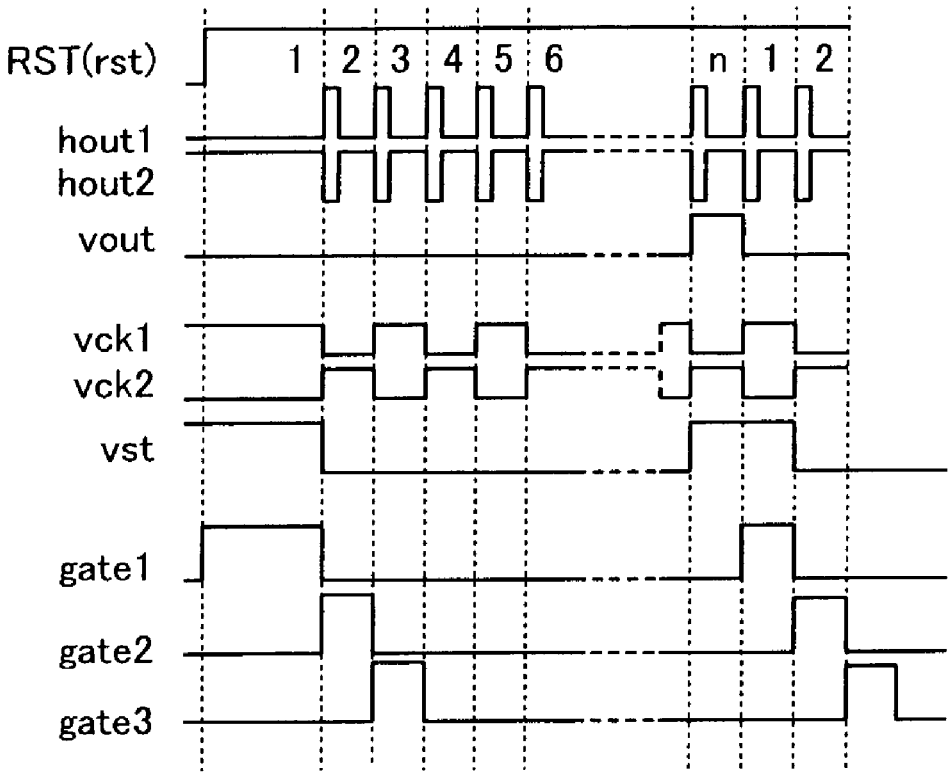
FIG. 5 is a timing chart of scanning system driving signals in the display according to the first embodiment of the present invention.

According to the first embodiment, the scanning system start signal vst goes high in response to the reset signal RST and goes low on the leading edge of the gate line gate2, as shown in FIG. 5. The first gate line gate1 of the scanning system is so designed as to rise when the reset signal RST is released and goes high and to fall on the leading edge of the first signal hout.

The gate line gate1 is activated when all of the reset signal RST, the scanning system start signal vst and a scanning system synchronizing signal vck1 are high. The gate lines gate2 to gateN successively rise in response to the scanning system synchronizing signal vck1 and a scanning system synchronizing signal vck2.

Operations of the display according to the first embodiment are now described with reference to FIGS. 1 to 6.

(1) The reset signal RST is released and goes high, whereby the first gate line gate1 rises.

(2) Then, the pulse signal hst is generated in time with the clock hck. Thus, a drain line selection signal h-sw1 is activated. The video signal is input in the drain lines while the drain line selection signal h-sw1 is activated.

(3) When a final drain line selection signal h-swn is activated, the signal hout indicating termination of the data system scanning is generated.

(4) The generation of the signal hout leads to the leading edge of the next gate line gate2 and generation of the signal hst.

(5) When the final gate line gateN rises due to repetition of the aforementioned operations (2) and (3), a signal vout indicating termination of single screen scanning is generated.

(6) This signal vout leads to the leading edge of the gate line gate1 and generation of the signal hst.

According to the first embodiment, as hereinabove described, the panel 100 stores the data system control signal generation circuit (the dot clock generation circuit 1, the data system synchronizing signal generation circuit 2 and the data system start signal generation circuit 3) for generating the signals controlling the data system driving circuit 51 and the scanning system control signal generation circuit (the scanning system synchronizing signal generation circuit 4 and the scanning system start signal generation circuit 5) for generating the signals controlling the scanning system driving circuit 52, whereby the number of wires in a connector part connecting the panel 100 with the external IC 20 can be reduced and hence the size of the connector part can be reduced. Also when the panel 100 including the pixel part 50 is miniaturized, therefore, the size of the connector part can be easily reduced in correspondence to the miniaturization of the panel 100.

According to the first embodiment, further, the number of wires of the connector part can be so reduced that the cost for the connector part can be reduced. In addition, the number of output pins of the external IC 20 can be reduced, whereby the cost for a package can be reduced. Further, the space for the wires is reduced, whereby a board for carrying the external IC 20 itself can be miniaturized thereby enabling cost reduction. In addition, the number of wires is so reduced that the external IC 20 can be easily designed and the design cost can be reduced as a result.

According to the first embodiment, a miniature active matrix display can be implemented at a low cost due to the aforementioned effects. Thus, the display can be applied to a view finder of a miniature and high-precision video camera, a display employed for a portable telephone or a PDA (personal display assistant) or the like.

Second Embodiment

Figure 7:
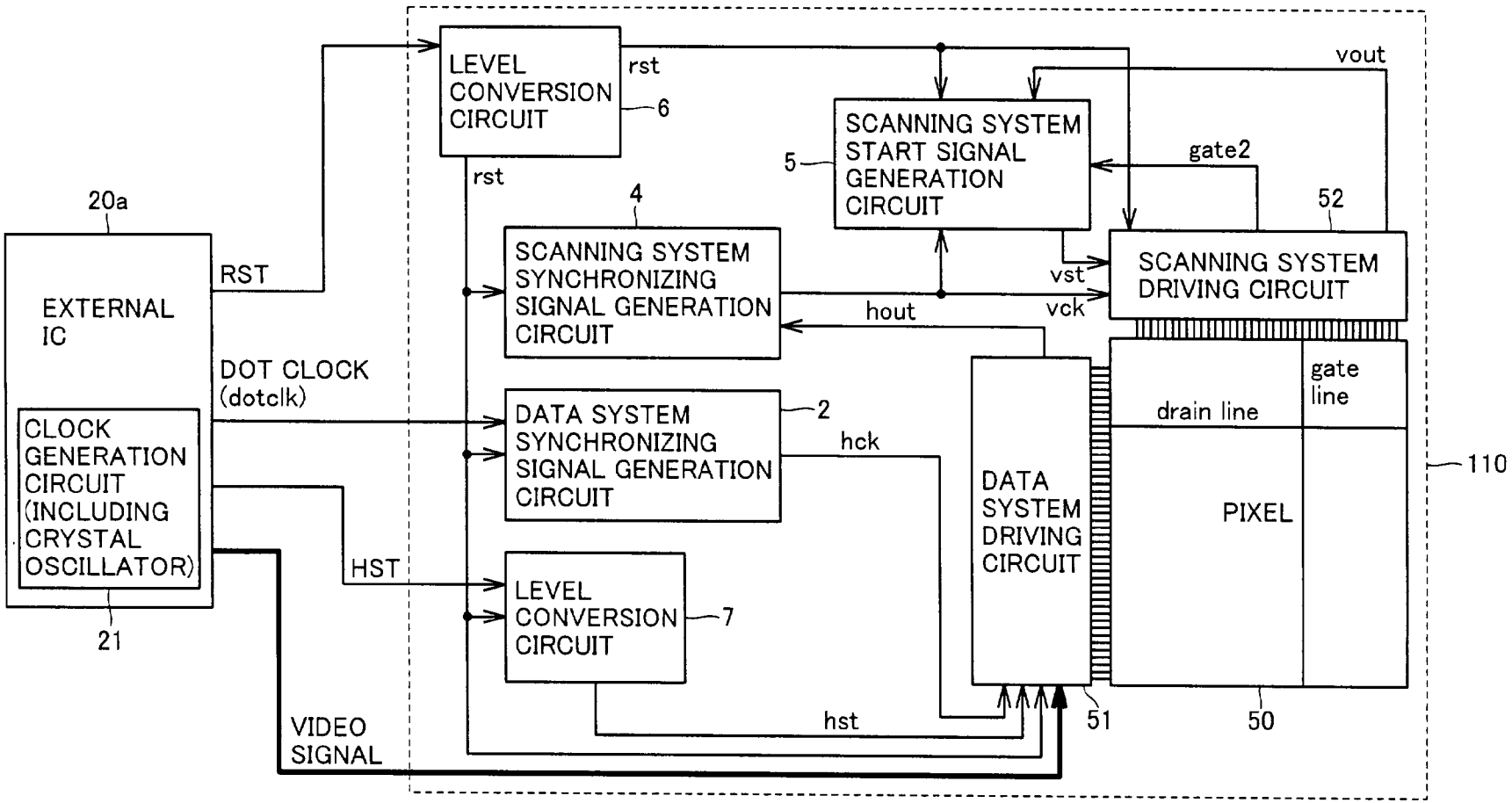
FIG. 7 is a block diagram showing the overall structure of a display according to a second embodiment of the present invention.

FIG. 7 shows the circuit structure of a display according to a second embodiment of the present invention, which receives a dot clock dotclk and a data system start signal HST from an external IC 20*a* dissimilarly to the aforementioned first embodiment. Therefore, a panel 110 stores a data system synchronizing signal generation circuit 2, a scanning system synchronizing signal generation circuit 4, a scanning system start signal generation circuit 5 and level conversion circuits 6 and 7 without the clock generation circuit 1 and the data system start signal generation circuit 3 according to the aforementioned first embodiment.

The level conversion circuit 6 is employed for level-converting the amplitude (3 to 5 V) of an external signal RST to 8 to 15 V, and the level conversion circuit 7 is employed for level-converting the amplitude (3 to 5 V) of an external signal HST to 8 to 15 V.

According to the second embodiment, the external IC 20*a* supplying the dot clock dotclk stores a clock generation circuit 21 including a crystal oscillator.

According to the second embodiment, as hereinabove described, the panel 110 stores the data system synchronizing generation circuit 2 included in a data system control signal generation circuit generating control signals for controlling a data system driving circuit 51 and a scanning control signal generation circuit (the scanning system synchronizing signal generation circuit 4 and the scanning system start signal generation circuit 5) generating control signals for a scanning system driving circuit 52, whereby the number of wires in a connector part connecting the panel 110 with the external IC 20*a* can be reduced as compared with a case of externally inputting all data system control signals and scanning system control signals in the panel 110. Also when the panel 110 including a pixel part 50 is miniaturized, therefore, the size of the connector part can be reduced in correspondence to the miniaturization of the panel 110. However, the degree of size reduction of the connector part is larger in the first embodiment.

Third Embodiment

Figure 8:
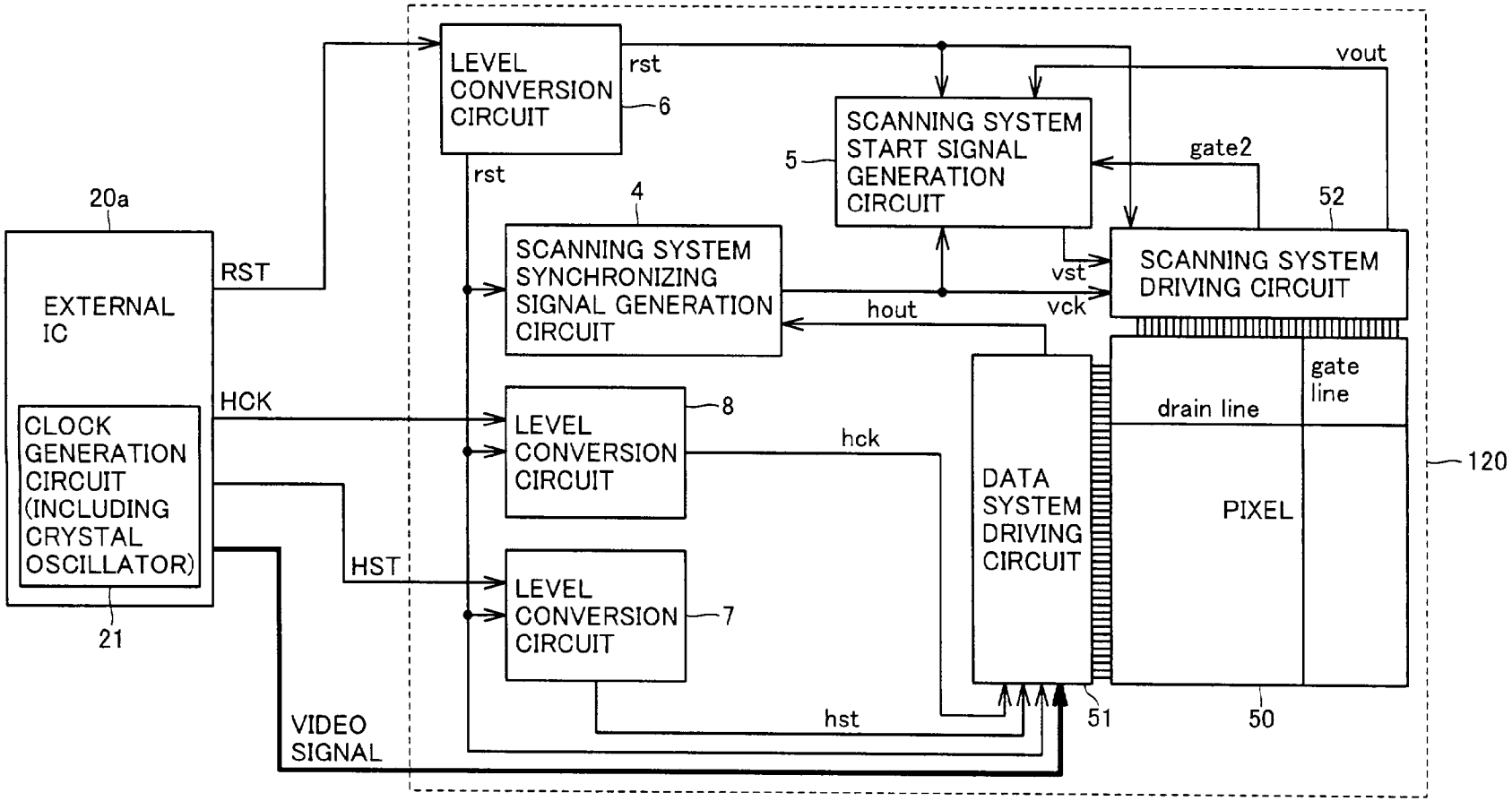
FIG. 8 is a block diagram showing the overall structure of a display according to a third embodiment of the present invention.

Referring to FIG. 8, all data system control signals HCK and HST are externally input in a panel 120 while a scanning system synchronizing signal generation circuit 4 and a scanning system start signal generation circuit 5 stored in the panel 120 generate scanning system control signals in a display according to a third embodiment of the present invention.

According to the third embodiment, therefore, the panel 120 stores a level conversion circuit 7 for level-converting the amplitude (3 to 5 V) of the external signal HST to 8 to 15 V and a level conversion circuit 8 for level-converting the amplitude (3 to 5 V) of the external signal HCK to 8 to 15 V. Similarly to the aforementioned first and second embodiments, the panel 120 also stores a level conversion circuit 6 for level-converting the amplitude (3 to 5 V) of an external signal RST to 8 to 15 V.

According to the third embodiment, as hereinabove described, the scanning system synchronizing signal generation circuit 4 and the scanning system start signal generation circuit 5 for generating control signals driving a scanning system driving circuit 52 are formed in the panel 120, whereby the number of the wires in the connector part connecting the panel 120 with the external IC 20*a* can be reduced as compared with a case of externally supplying the scanning system control signals to the panel 120. Also when the panel 120 including a pixel part 50 is miniaturized, therefore, the size of the connector part can be reduced in correspondence to the miniaturization of the panel 120.

Fourth Embodiment

Figure 9:
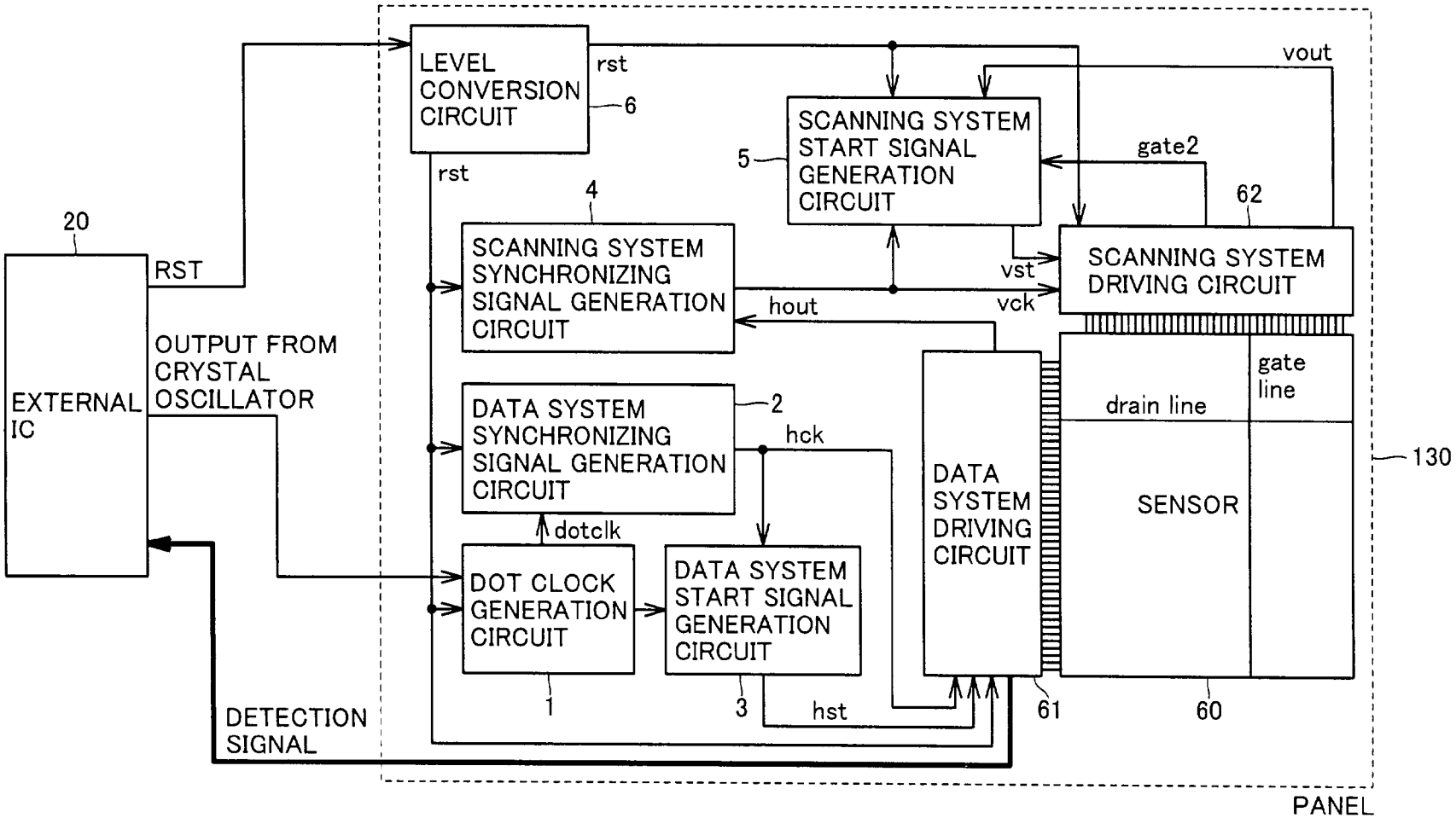
FIG. 9 is a block diagram showing the overall structure of a signal detector (sensor) according to a fourth embodiment of the present invention.
Figure 10:
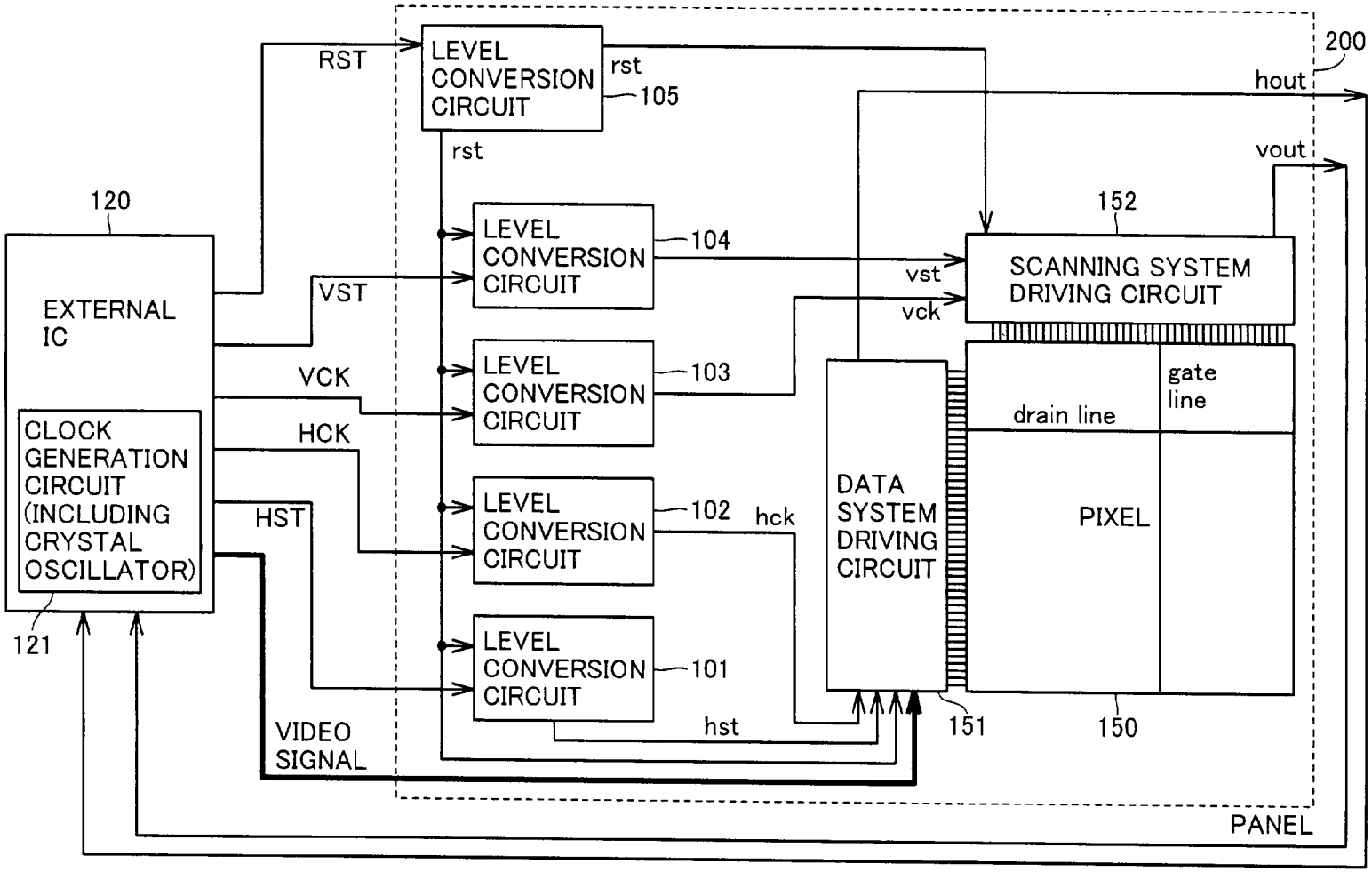
FIG.10 PRIOR ART
FIG. 10 is a block diagram showing the overall structure of a conventional display.
Figure 11:
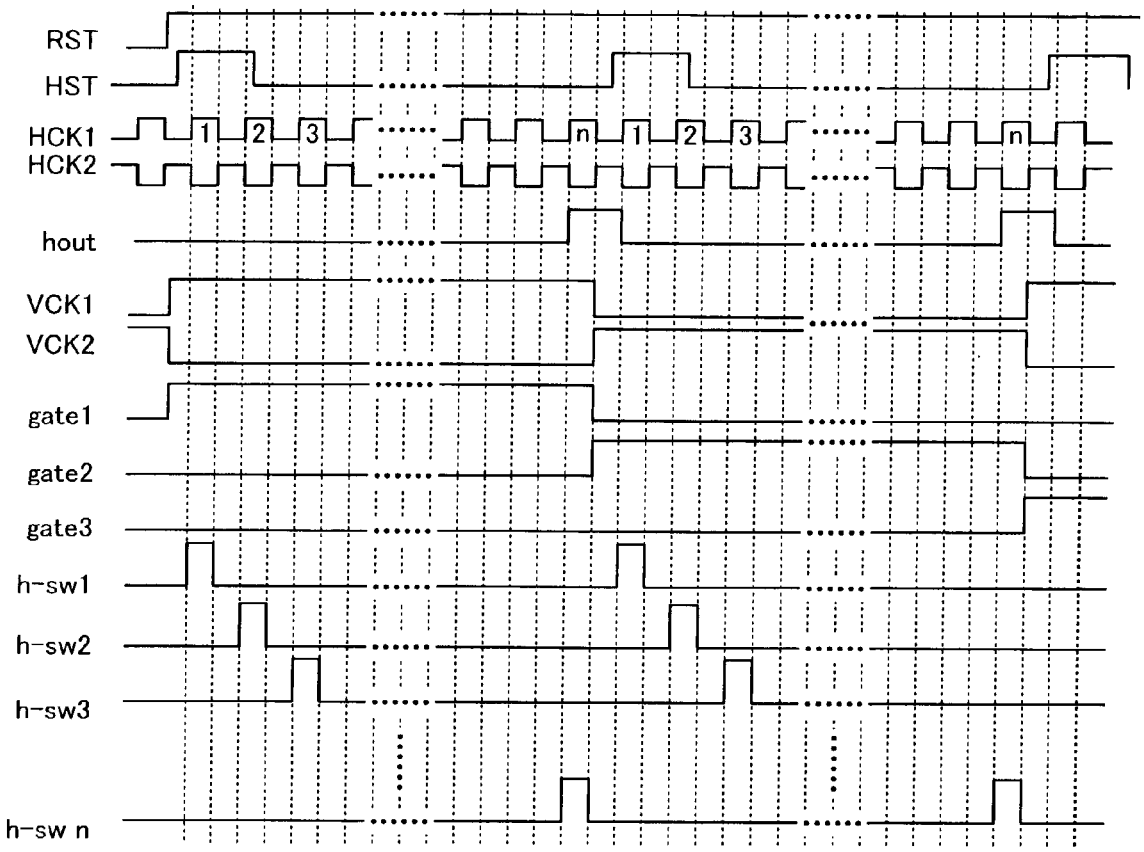
FIG.11 PRIOR ART
FIGS. 11 to 13 are timing charts showing control signals for the conventional display.
Figure 12:
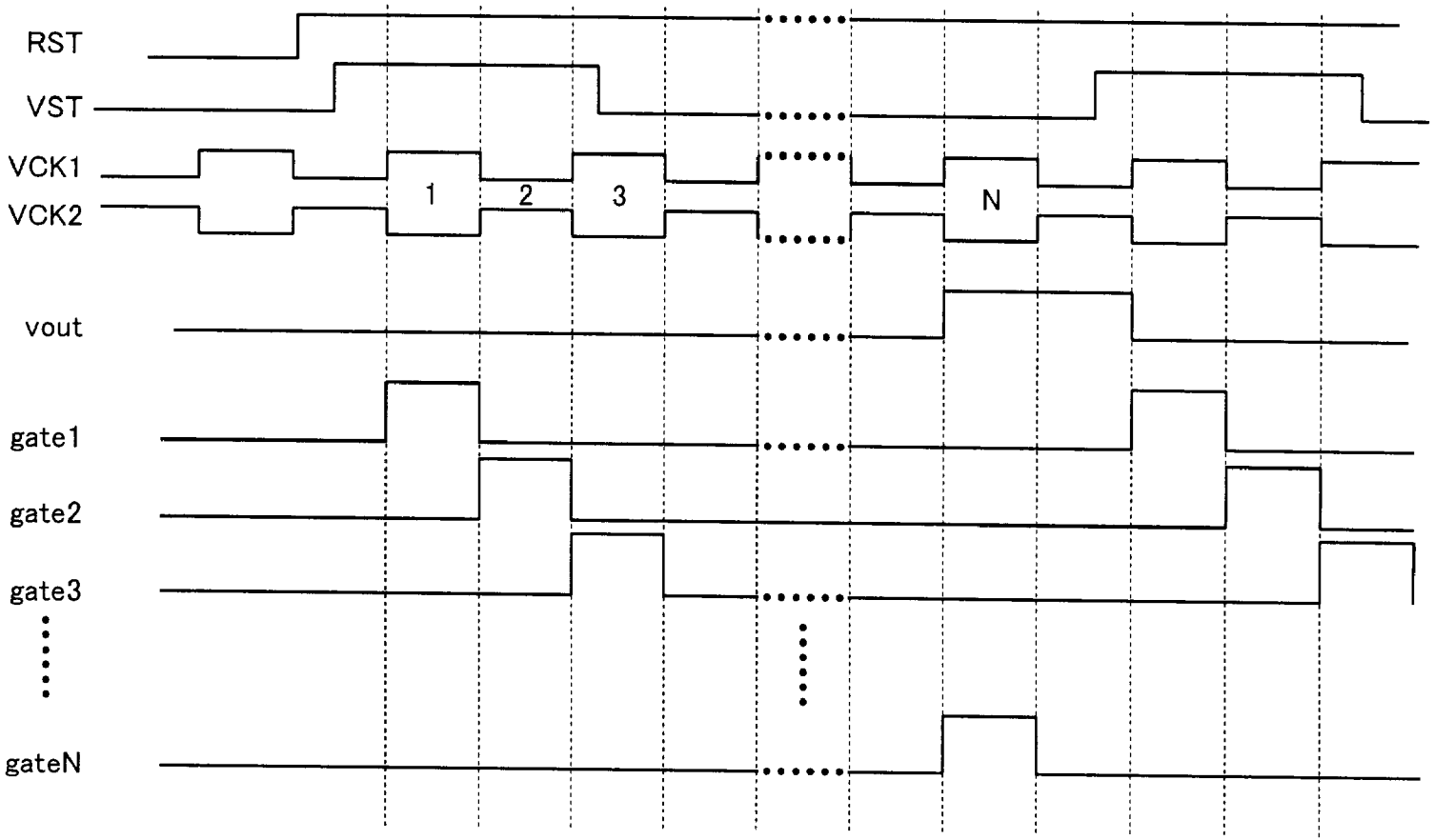
FIG.12 PRIOR ART
Figure 13:
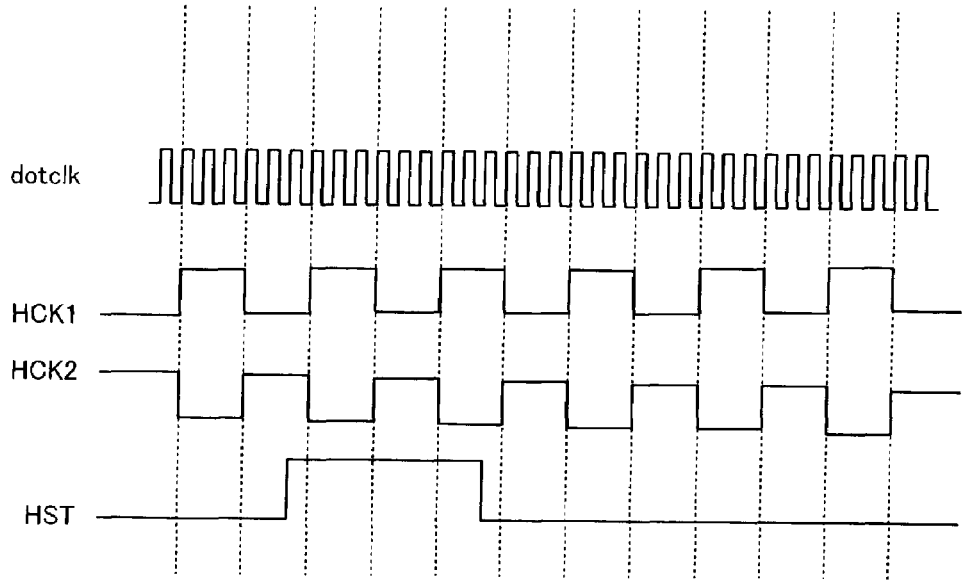
FIG.13 PRIOR ART
Figure 14:
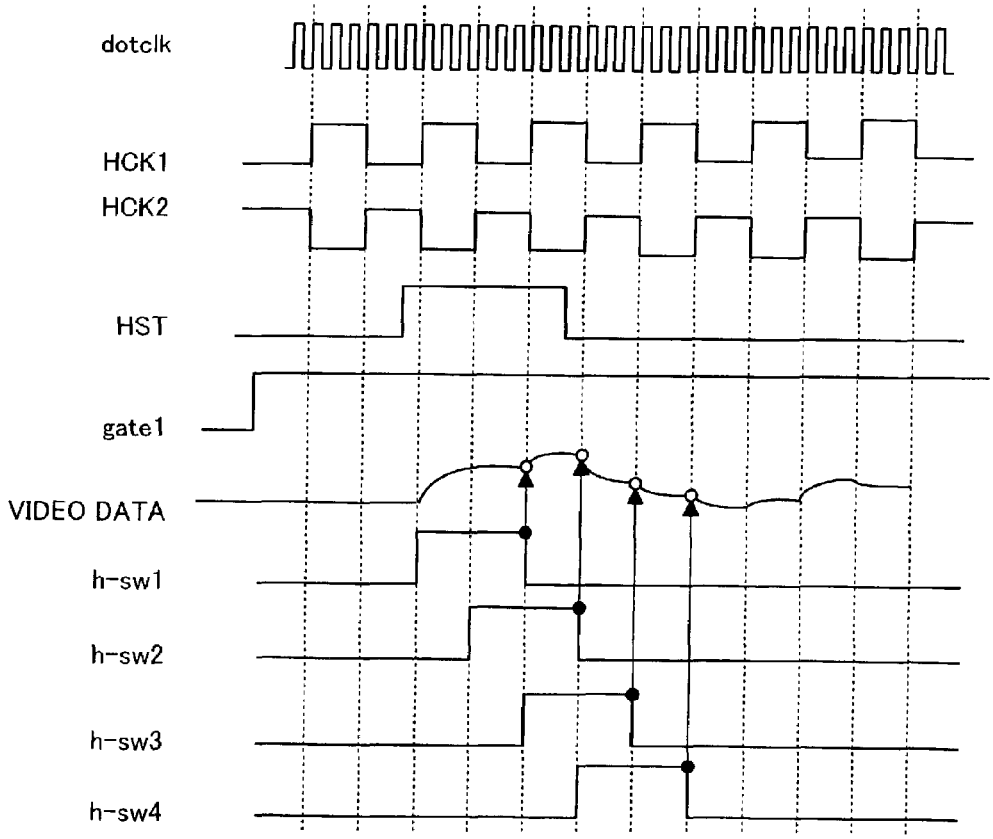
FIG.14 PRIOR ART
FIG. 14 is a timing chart for illustrating the relation between a data capture signal and video data in the conventional display.
Figure 15:
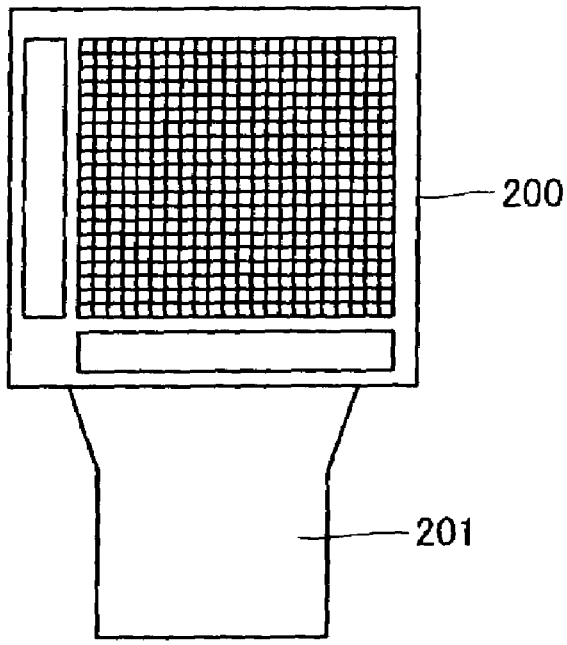
FIG.15 PRIOR ART
FIG. 15 schematically illustrates the relation between a panel part and a connector part of the conventional display not yet miniaturized.
Figure 16:
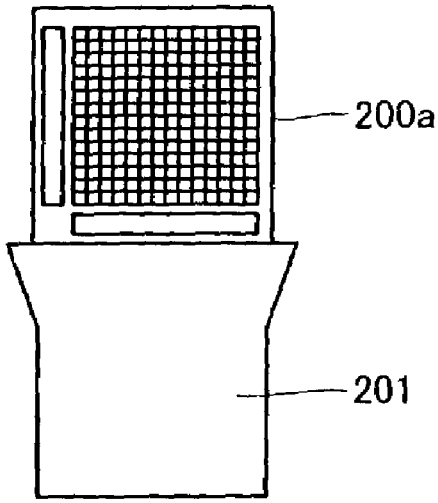
FIG.16 PRIOR ART
FIG. 16 schematically illustrates the relation between a panel part and a connector part of a miniaturized conventional display.

Referring to FIG. 9, a signal detector (sensor) according to a fourth embodiment of the present invention is provided with a sensor part 60 in place of the pixel part 50 provided in each of the aforementioned first to third embodiments. More specifically, the fourth embodiment provides a device capable of detecting a sheetlike state by detecting light, a temperature or a pressure as an electric signal. The remaining structure of the fourth embodiment is similar to that of the first embodiment.

In the sensor according to the fourth embodiment, a panel 130 stores a data system control signal generation circuit (a dot clock generation circuit 1, a data system synchronizing signal generation circuit 2 and a data system start signal generation circuit 3) for generating control signals driving a data system driving circuit 61 and a scanning system control signal generation circuit (a scanning system synchronizing signal generation circuit 4 and a scanning system start signal generation circuit 5) for generating control signals driving a scanning system driving circuit 62. Thus, the number of wires in a connector part for connecting the panel 130 with an external IC 20 can be reduced. Also when the panel 130 including the sensor part 60 is miniaturized, the size of the connector part for connecting the panel 130 with the external IC 20 can consequently be easily reduced in correspondence to the miniaturization of the panel 130.

Although the present invention has been described and illustrated in detail, it is clearly understood that the same is by way of illustration and example only and is not to be taken by way of limitation, the spirit and scope of the present invention being limited only by the terms of the appended claims.

For example, while the scanning system synchronizing signal generation circuit 4 is formed by five stages including the two clocked inverters 41 and the tree inverters 43*a* to 43*c* in each of the aforementioned embodiments, the present invention is not restricted to this but the scanning system synchronizing signal generation circuit 4 may alternatively have another structure so far as the same is formed by odd stages.

What is claimed is:

1. A semiconductor device including:

a pixel part or a sensor part arranged in the form of a matrix;

a scanning system driving circuit driving a gate line;

a data system driving circuit driving a drain line; and a scanning system control signal generation circuit generating a control signal for said scanning system driving circuit, formed on an identical substrate, wherein said scanning system control signal generation circuit includes:

a scanning system synchronizing signal generation circuit generating a scanning system synchronizing signal using both of a reset signal and a signal indicating that data system scanning reaches the final stage as input data is constituted by a single circuit, and a scanning system start signal generation circuit generating a start signal on the basis of at least any of said reset signal, said scanning system synchronizing signal, a signal related to a gate line activation signal rising second and a signal indicating that gate system scanning reaches the final stage.

2. The semiconductor device according to claim 1, wherein a data system control signal generation circuit generating a control signal for said data system driving circuit is at least partially formed on said identical substrate.

3. The semiconductor device according to claim 2, wherein said data system control signal generation circuit includes:

a basic clock generation circuit for generating a basic clock for said control signal, a data system synchronizing signal generation circuit generating a data system synchronizing signal on the basis of said basic clock, and a data system start signal generation circuit generating a start signal on the basis of said basic clock and said data system synchronizing signal, and at least said data system synchronizing signal generation circuit and said data system start signal generation circuit are formed on said identical substrate.

4. The semiconductor device according to claim 3, wherein said basic clock generation circuit is also formed on said identical substrate in addition to said data system synchronizing signal generation circuit and said data system start signal generation circuit.

5. The semiconductor device according to claim 4, wherein said data system synchronizing signal generation circuit has a function of dividing the output cycle of said basic clock generation circuit to a prescribed magnification.

6. The semiconductor device according to claim 5, wherein said data system synchronizing signal generation circuit includes a plurality of inverters to have an odd-stage cycle.

7. The semiconductor device according to claim 1, wherein a first level conversion circuit for converting the voltage level of an externally input reset signal is further formed on said identical substrate.

8. The semiconductor device according to claim 7, wherein a second level conversion circuit for converting the voltage level of an externally input data system start signal is further formed on said identical substrate.

9. The semiconductor device according to claim 8, wherein a third level conversion circuit for converting the voltage level of an externally input data system synchronizing signal is further formed on said identical substrate.

10. A display including:

a pixel part arranged in the form of a matrix;

a scanning system driving circuit driving a gate line;

a data system driving circuit driving a drain line; and a scanning system control signal generation circuit generating a control signal for said scanning system driving circuit, formed on an identical substrate, wherein said scanning system control signal generation circuit includes:

a scanning system synchronizing signal generation circuit generating a scanning system synchronizing signal using both of a reset signal and a signal indicating that data system scanning reaches the final stage as input data is constituted by a single circuit, and a scanning system start signal generation circuit generating a start signal on the basis of at least any of said reset signal, said scanning system synchronizing signal, a signal related to a gate line activation signal rising second and a signal indicating that gate system scanning reaches the final stage.

11. The display according to claim 10, wherein a data system control signal generation circuit generating a control signal for said data system driving circuit is at least partially formed on said identical substrate.

12. The display according to claim 11, wherein said data system control signal generation circuit includes:

a basic clock generation circuit for generating a basic clock for said control signal, a data system synchronizing signal generation circuit generating a data system synchronizing signal on the basis of said basic clock, and a data system start signal generation circuit generating a start signal on the basis of said basic clock and said data system synchronizing signal, and at least said data system synchronizing signal generation circuit and said data system start signal generation circuit are formed on said identical substrate.

13. The display according to claim 12, wherein said basic clock generation circuit is also formed on said identical substrate in addition to said data system synchronizing signal generation circuit and said data system start signal generation circuit.

14. A signal detector including:

a sensor part arranged in the form of a matrix;

a scanning system driving circuit driving a gate line;

a data system driving circuit driving a drain line; and a scanning system control signal generation circuit generating a control signal for said scanning system driving circuit, formed on an identical substrate, wherein said scanning system control signal generation circuit includes:

a scanning system synchronizing signal generation circuit generating a scanning system synchronizing signal using both of a reset signal and a signal indicating that data system scanning reaches the final stage as input data is constituted by a single circuit, and a scanning system start signal generation circuit generating a start signal on the basis of at least any of said reset signal, said scanning system synchronizing signal, a signal related to a gate line activation signal rising second and a signal indicating that gate system scanning reaches the final stage.

15. The signal detector according to claim 14, wherein a data system control signal generation circuit generating a control signal for said data system driving circuit is at least partially formed on said identical substrate.

16. The signal detector according to claim 15, wherein said data system control signal generation circuit includes:

a basic clock generation circuit for generating a basic clock for said control signal, a data system synchronizing signal generation circuit generating a data system synchronizing signal on the basis of said basic clock, and a data system start signal generation circuit generating a start signal on the basis of said basic clock and said data system synchronizing signal, and at least said data system synchronizing signal generation circuit and said data system start signal generation circuit are formed on said identical substrate.

17. The signal detector according to claim 16, wherein said basic clock generation circuit is also formed on said identical substrate in addition to said data system synchronizing signal generation circuit and said data system start signal generation circuit.

* * * * *